US005784981A

United States Patent [19]

Graham, Sr.

[11] Patent Number: 5,784,981

[45] Date of Patent: Jul. 28, 1998

[54] V-SHAPED RETRIEVABLE ANCHOR

[76] Inventor: Leonard R. Graham, Sr., 11318 E. Highway 84, Axtell, Tex. 76624-1403

[21] Appl. No.: 932,185

[22] Filed: Sep. 17, 1997

Related U.S. Application Data

[60] Provisional application No. 60/026,214 Sep. 17, 1996.

[51] Int. Cl.[6] ..... B63B 21/46

[52] U.S. Cl. ..... 114/299; 114/301

[58] Field of Search ..... 114/297, 294, 114/299, 301, 304

[56] References Cited

U.S. PATENT DOCUMENTS

| | | | |
|---|---|---|---|
| 2,816,522 | 12/1957 | Root | 114/299 |
| 3,182,625 | 5/1965 | White . | |
| 3,305,984 | 2/1967 | Borcuk | 114/301 |
| 4,417,538 | 11/1983 | El-Ramey . | |
| 4,523,539 | 6/1985 | Granger . | |
| 4,721,054 | 1/1988 | Kobayashi . | |
| 4,836,126 | 6/1989 | Kobayashi . | |
| 4,846,093 | 7/1989 | Norena . | |
| 4,848,261 | 7/1989 | Kobayashi . | |
| 4,987,847 | 1/1991 | Kobayasgi . | |
| 5,074,235 | 12/1991 | Kobayashi . | |
| 5,188,055 | 2/1993 | Kershner . | |
| 5,207,775 | 5/1993 | Piton et al. . | |
| 5,353,731 | 10/1994 | Richter . | |

FOREIGN PATENT DOCUMENTS

| | | | |
|---|---|---|---|
| 596751 | 4/1960 | Canada . | |
| 2592624 | 7/1987 | France . | |
| 2678574 | 1/1993 | France . | |
| 63-31892 | 2/1988 | Japan . | |
| 1556998 | 4/1990 | U.S.S.R. | 114/301 |
| 1100518 | 1/1968 | United Kingdom . | |

*Primary Examiner*—Ed L. Swinehart
*Attorney, Agent, or Firm*—Richard C. Litman

[57] ABSTRACT

A boat anchor assembly which allows the boat anchor to be retrieved easily, even when fouled in rocks or debris on a lake bottom, for example. The anchor includes a V-shaped anchor, structure for attaching an anchor line to the end of the anchor shank, an anchoring line, and a breakable tie. The end of the anchor line is attached to the anchor crown and removably attached by a tie to the structure for attaching an anchor line to the end of the anchor's shank. The tie will break when sufficient force is applied to the anchor line, thus to transfer the pulling force exerted by the anchor line from the end of the shank to the crown so that the anchor may be easily pulled from any entanglements. The entire V-shaped anchor is coated in a plastic or other suitable material to prevent rust, and the arm and shank of the V-shaped anchor are tapered towards their ends so as easily to penetrate a brush pile or rock bed.

13 Claims, 3 Drawing Sheets

V-SHAPED RETRIEVABLE ANCHOR

CROSS-REFERENCE TO RELATED APPLICATION

This application claims the benefit of U.S. Provisional Pat. application Ser. No. 60/026,214, filed Sep. 17, 1996.

BACKGROUND OF THE INVENTION

1. Field of the Invention

The present invention relates to a boat anchoring system and, more specifically, to a boat anchoring system with a V-shaped anchor which is easy to retrieve even when it becomes fouled in rocks, debris, weeds, etc..

2. Description of Related Art

Anchors for small boats are often prone to becoming snagged in brush piles or rocks on a lake bottom, preventing the anchor from being easily retrieved, and sometimes resulting in the loss of the anchor all together. Several ways of dealing with this problem have been disclosed in the related art. These include allowing the anchor flukes to selectively pivot to effect their release and transferring the pulling force of the anchor line from the anchor shank to the crown of the anchor. The pulling force of the anchor line is usually transferred from the shank to the crown either by providing a means to release the anchor line from the anchor shank and connect it to the anchor crown or by attaching the anchor line to a longitudinally extending slot in the anchor's shank that allows the anchor line to slide from the end of the shank to the crown when the anchor is being retrieved.

U.S. Pat. No. 4,417,538, issued Nov. 29, 1983 to Thomas A. El-Ramey, discloses an anchor with a pair of broad flukes which are pivotally mounted on the anchor shank. The shank has a breakable tie thereon which limits the motion of the flukes on the shank. The tie is adapted to break when sufficient force is applied to the anchor line which allows the flukes to pivot freely and disengage themselves from any entanglements.

French Patent Number 2,678,574, issued Jan. 8, 1993 discloses an anchor with a pair of broad flukes which are mounted on an anchor shank having a pivoting anchor line member mounted thereon. The anchor line member is held in place by a pair of tabs which engage the main shaft of the shank until a sharp force is applied to the anchor line, at which point the anchor line member will rotate away from the flukes to transfer the pulling force of the anchor line to the crown of the anchor.

U.S. Pat. No. 3,182,625, issued Feb. 3, 1964 to Wilfred G. White, and Canadian Patent Number 596,751, issued Apr. 26, 1960, disclose boat anchors having flukes which pivot, and shanks with slots extending longitudinally therethrough to which an anchor line may be slidably attached. When the anchors are being retrieved, the anchor line is adapted to slide from the end of the shank to the crown to pull the anchor free from any entanglements, and the flukes are adapted to pivot into the plane of the shank to prevent the flukes from being further entangled.

U.S. Pat. No. 4,721,054, issued Jan. 26, 1988 to Satoru Kobayashi, and 4,848,261, issued Jul. 18, 1989 also to Satoru Kobayashi, disclose anchor systems which transfer the tension on the anchor line from the end of a pivoting shank to the crown of the anchor by using a retaining device mounted on the anchor line to detachably secure the anchor line to the end of the shank. When a weight is dropped down the anchor line, it strikes the retaining device, thereby releasing the anchor line from the end of the anchor's shank leaving it connected to the crown so that the anchor may be easily retrieved.

U.S. Pat. No. 4,836,126, issued Jun. 6, 1989 to Satoru Kobayashi and 4,987,847, issued Jan. 29, 1991, also to Satoru Kobayashi, and Japanese Patent Number 63-31892, issued Feb. 10, 1988, disclose anchor systems which differ from the teachings of the previously discussed patents, mainly in that the retaining device connects the anchor line to the end of the pivoting shank via a connection line rather than directly. When a weight is dropped down the anchor line, it strikes the retaining devise to transfer the pulling force of the anchor line to the connection line and thereby to the crown of the anchor.

U.S. Pat. No. 4,846,093, issued Jul. 11, 1989 to Alfonso G. Norena, discloses a boat anchoring system which allows a boat anchor to be retrieved easily by disconnecting the anchor line from the end of the shank, leaving it attached to the crown of the anchor. The anchor system of Norena uses an independent accessory to removably attach the anchor line to the end of the shank so that the anchor may be pulled up by the crown.

U.S. Pat. No. 5,074,235, issued Dec. 24, 1991 to Satoru Kobayashi, also discloses a boat anchor retrieving device which employs a weight that is dropped down the anchor line to release the anchor line from its connection to the end of the shank, leaving the line connected to the crown so that the anchor may be easily retrieved.

U.S. Pat. Nos. 5,188,055, issued Feb. 23, 1993 to Gary P. Kershner, and 4,523,539, issued Jun. 18, 1985 to Gerald M. Granger, disclose boat anchors with slidably attached anchor lines that allow the pulling force of the anchor line to be transferred from the end of the shank to the crown. The anchor of Kershner utilizes on a slot formed through the shank of the anchor and a ring on the end of the anchor line to allow the anchor line to slide on the shank while the anchor of granger utilizes a notched shank and a shank encircling ring on the end of the anchor line to allow the anchor line to slide on the shank.

British Patent Number 1,100,518, dated Jan. 24, 1968, by Georges E. Dial, also discloses a boat anchor with an anchor line slidably attached to a slot in the anchor's shank. The anchor of Dial also employs a pivoting shank to further facilitate the retrieval of the anchor.

U.S. Pat. No. 5,207,775, issued May 4, 1993 to Claude and Jacqueline Piton, discloses an anchor system that utilizes a device which releases an anchor chain from the shank of a V-shaped anchor, leaving it attached to the crown so that the anchor may be easily retrieved. The anchor system of Piton uses a V-shaped anchor with holes in its crown and its shank to provide attachment means for the anchor line.

French Patent Number 2,592,624, dated Jul. 10, 1987, by Jacques Abbadie, discloses a boat anchor system which utilizes an anchor line attached device to attach a rope to the anchor crown when the anchor is to be retrieved. The device slides down the main anchor line to connect a secondary anchor line with a line connected to the anchor crown.

U.S. Pat. No. 5,353,731, issued Oct. 11 1994 to Rayohl E. Richter discloses an anchor with a plurality of rod like flukes extending from a central hub member having a handle to which a the anchor line slidably attaches. The anchor line is adapted to slide from the top of the handle to the bottom thereof when the anchor is to be retrieved.

None of this related art, however, discloses a boat anchoring system with a V-shaped anchor and an anchoring line which is fixed to the crown of the anchor and which is removably attached to the shank of the V-shaped anchor with a plastic tie which is adapted to break when a predetermined, sufficient force is applied to the anchoring line, thus transferring the pulling force of the anchor line to the crown of the anchor.

None of the above inventions and patents, taken either singularly or in combination, is seen to describe the instant invention as claimed. Thus a V-shaped retrievable anchor system solving the aforementioned problems is desired.

SUMMARY OF THE INVENTION

The present invention relates to a boat anchor assembly which allows an anchor to be easily retrieved, even when entangled in rocks or debris on a lake bottom, for example. The anchor assembly is comprised of a V-shaped anchor having a means for releasably attaching an anchor line to the end of its shank, an anchoring line, and a breakable tie. The end of the anchor line is attached to the anchor crown and removably attached to the means for releasably attaching an anchor line to the end of the anchor shank using the tie. The tie is adapted to break when sufficient force is applied to the anchor line to transfer the pulling force exerted by the anchor line from the end of the shank to the crown so that the anchor may be easily pulled from any entanglements.

Additionally, the entire V-shaped anchor is coated in a plastic or other suitable material to prevent rust and the arm and shank of the V-shaped anchor are tapered towards their ends so as to easily penetrate a brush pile or rock bed.

Accordingly, it is a principal object of the invention to provide an anchor system which makes it easy to retrieve an anchor from a lake bottom even when it becomes snagged in brush piles or rocks, for example.

It is another object of the invention to provide an anchor system that utilizes an anchoring line which is removably attached to the anchor shank with a breakable tie and attached to the anchor crown, so that the when sufficient force is applied to the anchor line the pulling force of the anchor line will be transferred from the anchor shank to the anchor crown.

It is a further object of the invention to provide an anchor system with a V-shaped anchor having an anchor shank to which the anchor lines may be easily reattached with a breakable tie.

Still another object of the invention is to provide an anchor system with a V-shaped anchor which will not rust.

It is an object of the invention to provide improved elements and arrangements thereof in a V-shaped retrievable anchor for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
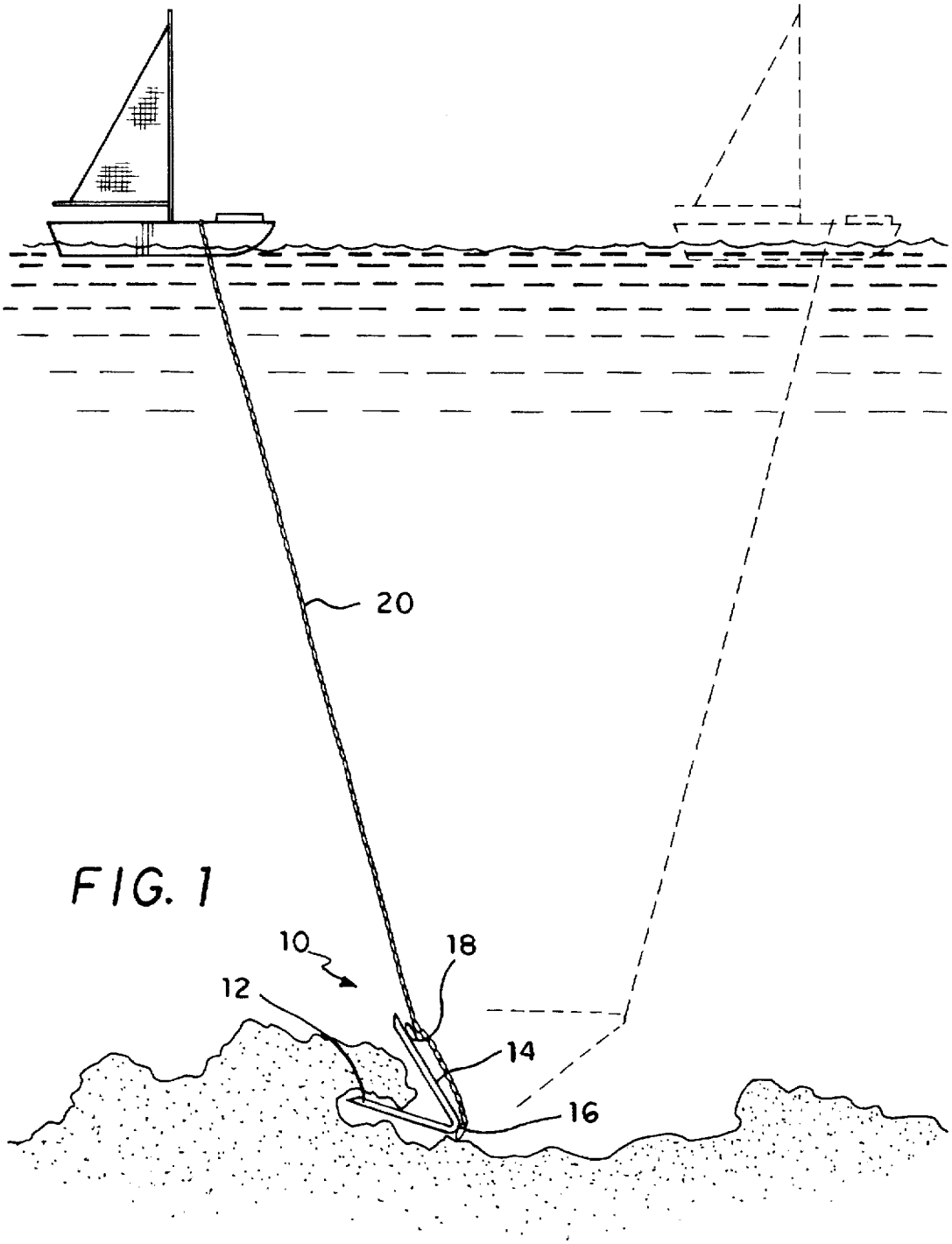
FIG. 1 is an environmental side view of the V-shaped retrievable anchor being released from a snagged position on a rocky lake bottom.

Referring to the drawings, FIG. 1 illustrates a boat anchor assembly with an easily retrieved anchor 10. The anchor assembly includes a V-shaped anchor 10 having an arm 12 and a shank 14, an anchor line 20, and a means for removably attaching the anchor line 20 to the shank 14 of the anchor 10.

The anchor 10 is formed of a single piece of metal which may be suitably coated with plastic, or other suitable rust-resistant material, e.g., a polymer. It is bent into an approximate V-shape which is defined by the shank 14 and the arm 12. The arm 12 and the shank 14 are joined at their proximal ends to form an acutely angled crown 16 therebetween.

Figure 2:
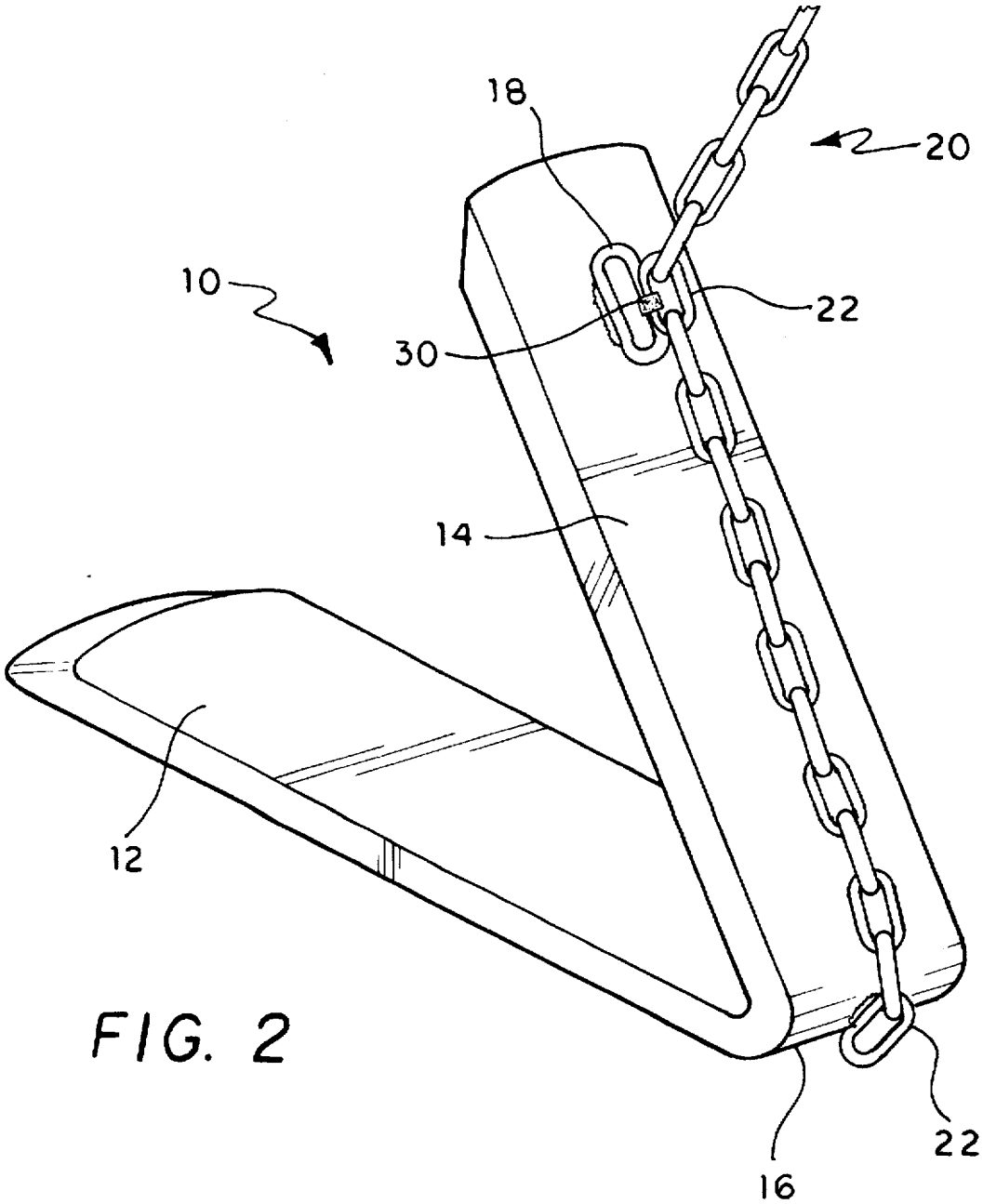
FIG. 2 is a perspective view of a V-shaped retrievable anchor according to the present invention.
Figure 3:
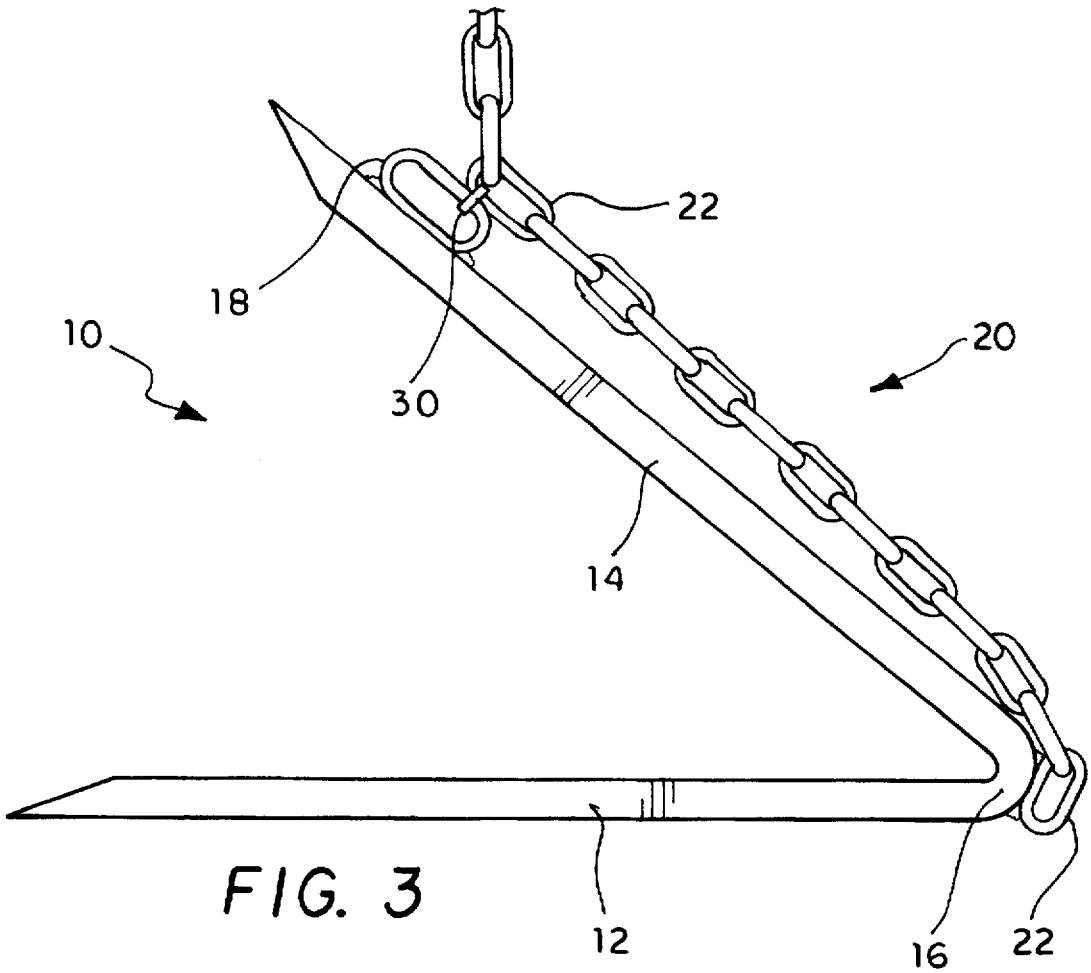
FIG. 3 is a side view of the V-shaped retrievable anchor showing the tapering arm.

The anchor line 20 is preferably in the form of a metal chain which is fixedly attached to the crown 16 of the anchor 10 at its bottom end. This is achieved either by welding or otherwise securing a link 22 on the bottom end of the anchor line 20 directly to the crown 16, as is shown in FIG. 2, or by using a U-shaped member (not shown) which is disposed through the link 22 on the bottom end of the anchor line 20 and is fixedly attached at its ends to the crown 16. In alternate embodiments, the anchor line 20 is formed of a metal chain adjacent its bottom end and formed of a rope or other suitable material along the majority of its length in order to reduce the cost and weight of the anchor line 20.

In order to provide the means for removably attaching the anchor line 20 to the shank 14 of the anchor 10, a plurality of breakable ties 30 are included. Each tie 30 is adapted to be secured around a link 22 in the chain forming the anchor line 20 at a predetermined shaft attaching point and a loop 18 attached to the distal end of the shaft 14 to secure the anchor line 20 to the shaft 14. The ties 30 are preferably of the type commonly referred to as zip ties wherein one end of a tie 30 may be inserted into a retaining device on the other end of the tie 30 to secure the tie 30 around the loop 18 and a link 22 in the anchor line 20.

The ties 30 each have a specific, predetermined tensile strength so they will break when a force exceeding a preselected value is applied to the anchor line 20. When this occurs, the pulling force applied to the anchor line 20 is transferred from the shaft 14 of the anchor 10 to the crown 16 so that the anchor 10 be more easily pulled free of any entanglements. Once the anchor 10 has been retrieved, another tie may be secured around the loop 18 and a link 22 in the anchor line 20 to reattach the anchor line to the shank 14 so that the anchor 10 may again be used to hold a boat in place on a body of water.

It is to be understood that the present invention is not limited to the embodiment described above, but encompasses any and all embodiments within the scope of the following claims.

I claim:

1. An anchor assembly structured to allow an anchor to be retrieved easily even when fouled, said retrievable anchor system comprising:

an anchor having a shank and an arm, said shank and said arm each having a distal end and a proximal end, said proximal ends of said shank and said arm being joined in V-fashion, thus to form an acute angled crown therebetween;

an anchor line having a top end and a bottom end, said bottom end being attached to said crown of said anchor, said anchor line having a shaft attaching portion disposed a predetermined, significant distance from said bottom end of said anchor line;

a tie being adapted to removably attach said shaft attaching portion of said anchor line to said distal end of said shank, said tie being adapted to break when a force exceeding a preselected value is applied to said anchor line, thus to release said shaft attaching portion of said anchor line from said shank, thereby transferring the pulling force applied to said anchor line from said shank to said crown to allow said anchor to be freed from entanglements.

2. The retrievable anchor assembly as defined in claim 1, wherein said distal end of said shank has a loop fixed thereto, said loop being structured to have said shaft attaching portion of said anchor line attached thereto with said tie.

3. The retrievable anchor system as defined in claim 2, wherein a plurality of said ties are included, said ties being structured to be secured around said shaft attaching portion of said anchor line and said loop to removably attach said shaft attaching porion of said anchor line to said distal end of said shank, so that said shaft attaching portion of said anchor line may be easily reattached to said shaft of said anchor after one of said ties is broken.

4. The retrievable anchor system as defined in claim 3, wherein said tie is made from a flexible material into an elongate strip having a first end and a second end, said first end of said tie being structured to be fixed to said second end of said tie.

5. The retrievable anchor assembly as defined in claim 1, wherein said arm and said shank are tapered at their respective said distal ends.

6. The retrievable anchor assembly as defined in claim 5, wherein said distal end of said shank has a loop fixedly attached thereto, said loop being structured to have said shaft attaching portion of said anchor line attached thereto with said tie.

7. The retrievable anchor system as defined in claim 6, wherein a plurality of said ties are included, said ties being structured to be secured around said shaft attaching portion of said anchor line and said loop to removably attach said shaft attaching porion of said anchor line to said distal end of said shank, so that said shaft attaching portion of said anchor line may be easily reattached to said shaft of said anchor after one of said ties is broken.

8. The retrievable anchor system as defined in claim 7, wherein said tie is made from a flexible material into an elongate strip having a first end and a second end, said first end of said tie being structured to be fixed to said second end of said tie.

9. The retrievable anchor system as defined in claim 1, wherein said anchor is coated with a rust resistant material.

10. The retrievable anchor assembly as defined in claim 9, wherein said arm and said shank are tapered at their respective said distal ends.

11. The retrievable anchor assembly as defined in claim 10, wherein said distal end of said shank has a loop fixed thereto, said loop being structured to have said shaft attaching portion of said anchor line attached thereto with said tie.

12. The retrievable anchor system as defined in claim 11, wherein a plurality of said ties are included, said ties being structured to be secured around said shaft attaching portion of said anchor line and said loop to removably attach said shaft attaching porion of said anchor line to said distal end of said shank, so that said shaft attaching portion of said anchor line may be easily reattached to said shaft of said anchor after one of said ties is broken.

13. The retrievable anchor system as defined in claim 12, wherein said tie is made from a flexible material into an elongate strip having a first end and a second end, said first end of said tie being structured to be fixed to said second end of said tie.

* * * * *